United States Patent [19]

Kretschmer et al.

[11] 4,455,949

[45] Jun. 26, 1984

[54] BURNER FOR GASIFICATION OF POWDERY FUELS

[75] Inventors: Horst Kretschmer; Klaus Fleischer; Peter Göhler; Manfred Schingnitz, all of Freiburg; Friedrich Berger, Brand-Erbisdorf, all of German Democratic Rep.; Aleksander Jegorow, Moskwa, U.S.S.R.; Vasilij Fedotov, Moskwa, U.S.S.R.; Vladimir Gavrilin, Moskwa, U.S.S.R.; Ernest Gudymov, Moskwa, U.S.S.R.; Vladimir Semenov, Moskwa, U.S.S.R.; Igol Achmatov, Moskwa, U.S.S.R.; Nikolaj Majdurov, Moskovsk, U.S.S.R.; Evgenij Avraamov, Moskwa, U.S.S.R.

[73] Assignee: Brennstoffinstitut Freiberg, Freiberg, German Democratic Rep.

[21] Appl. No.: 121,254

[22] Filed: Feb. 13, 1980

[51] Int. Cl.[3] ..... F23D 1/00

[52] U.S. Cl. ..... 110/263; 431/13; 431/79; 431/187; 239/422; 239/424.5

[58] Field of Search ..... 431/13, 79, 80, 174, 431/182, 187, 188, 190, 278, 284, 285, 351, 353; 110/261, 263, 265, 264; 239/422, 424, 424.5, 433

[56] References Cited

U.S. PATENT DOCUMENTS

| | | | |
|---|---|---|---|
| 3,299,841 | 1/1967 | Hemker et al. | 431/79 |
| 3,889,933 | 6/1975 | Jaquay | 239/422 |
| 4,147,116 | 4/1979 | Graybill | 110/263 |
| 4,157,889 | 6/1979 | Bonnel | 431/182 |
| 4,373,900 | 2/1983 | Eckelmann | 431/182 |

FOREIGN PATENT DOCUMENTS

| | | | |
|---|---|---|---|
| 140230 | 10/1979 | Japan | 110/263 |

*Primary Examiner*—Lee E. Barrett

*Attorney, Agent, or Firm*—Michael J. Striker

[57] ABSTRACT

The burner is formed of a tubular housing including a central tubular passage and a boundary annular passage for feeding into the gasification reactor under high speed a carburation medium such as oxygen or steam. At least three intermediate channels of coaxial annular sections are symmetrically arranged about the central channel and each communicates with a separate inlet conduit for feeding a mixture of powderized fuel with a carrier gas. The transition between the annular intermediate channel and the tubular inlet conduits is made such that the varying outline of the cross-section encloses the same area as the tubular inlet conduit or the annular section intermediate channel. The central tubular channel and the boundary annular channel for feeding the carburation fluid is configurated so as to divert one stream of the carburation fluid at an angle of about 45° toward the axially directed jet of the powderized fuel mixture.

2 Claims, 17 Drawing Figures

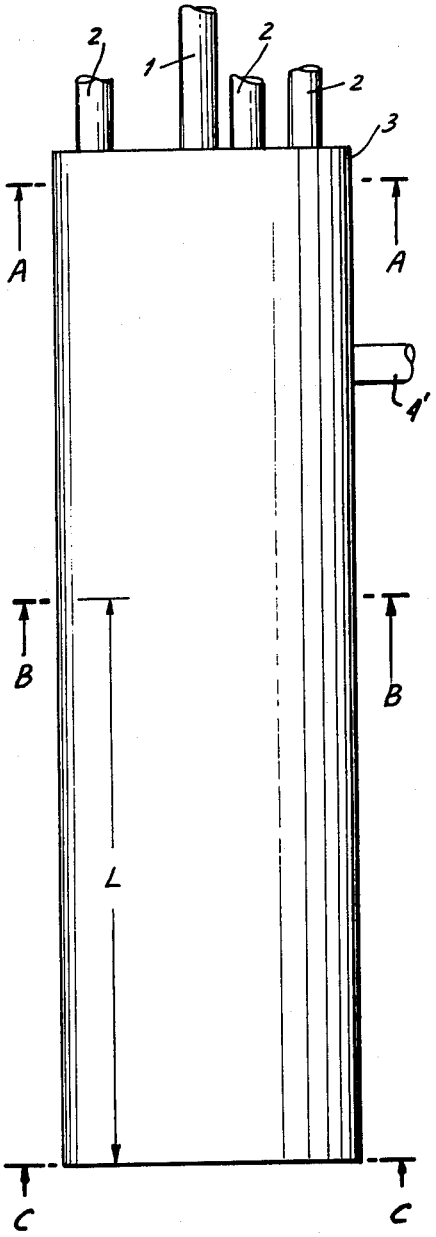
FIG. 2
FIG. 2a
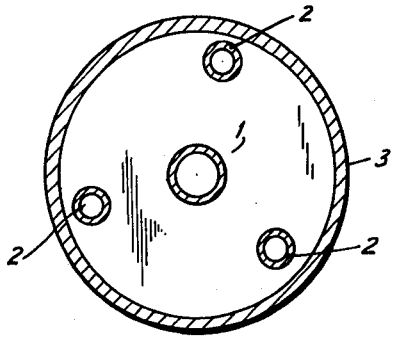
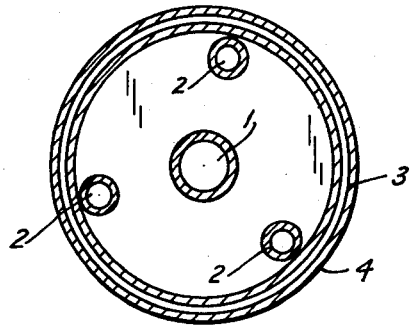
FIG. 2b
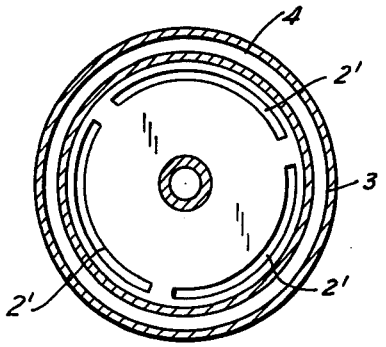
FIG. 2c

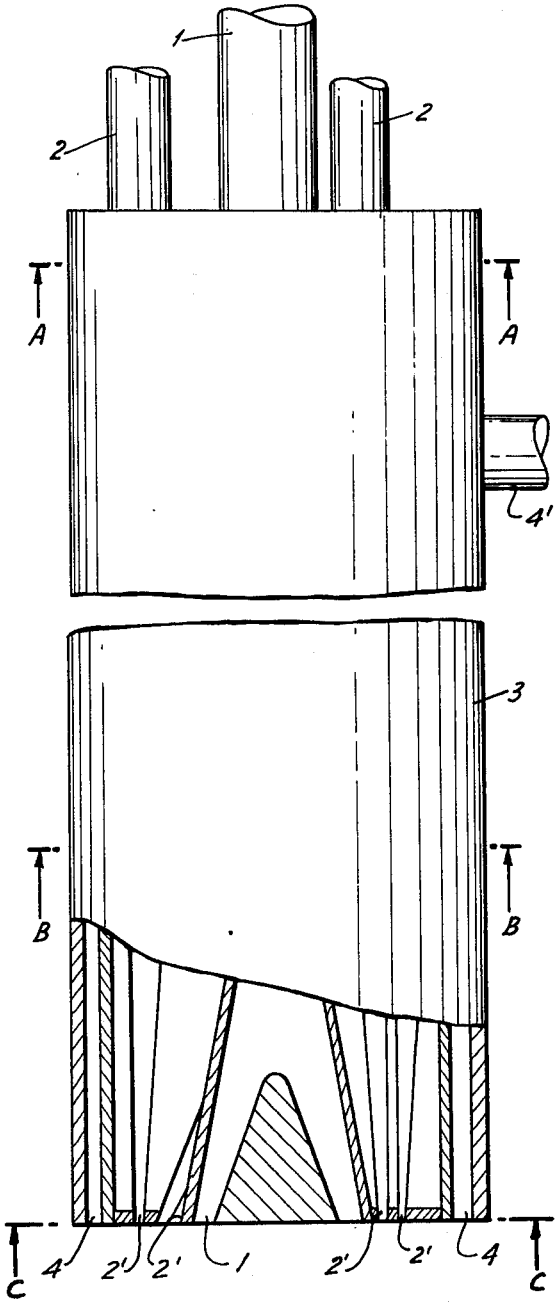
FIG. 3
FIG. 3a
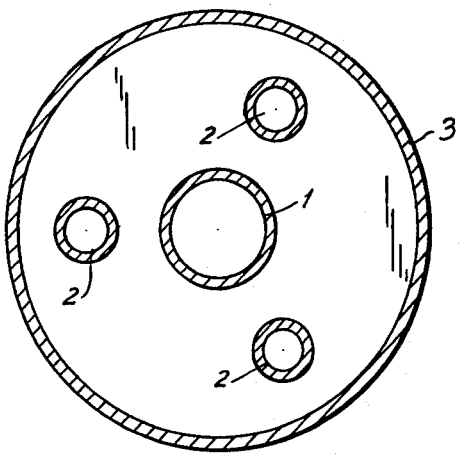
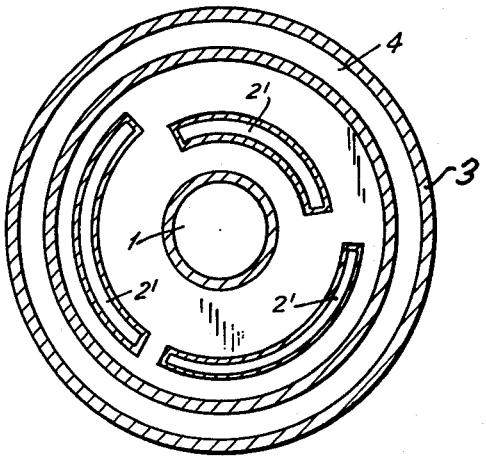
FIG. 3b

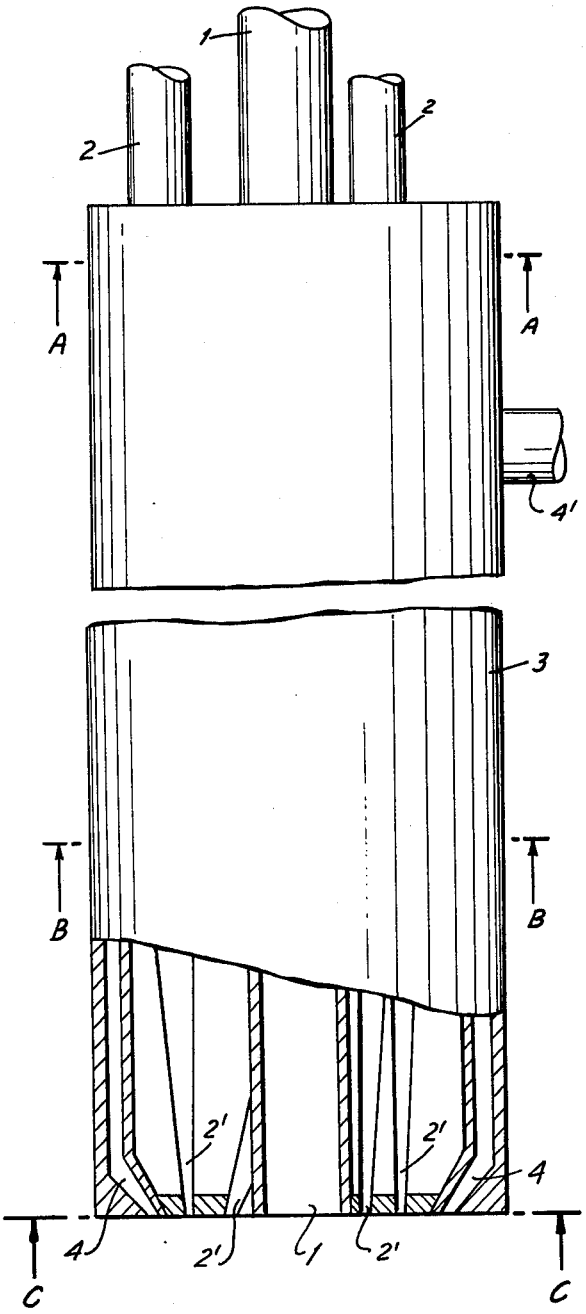
FIG. 4
FIG. 4a
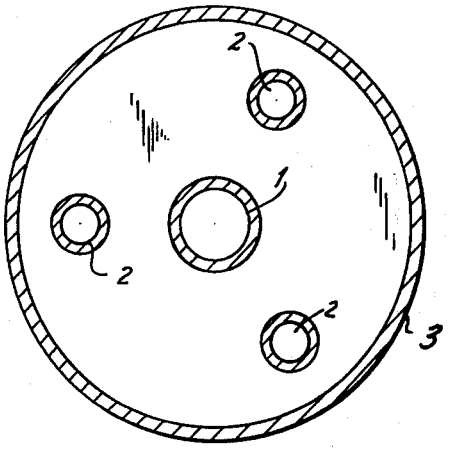
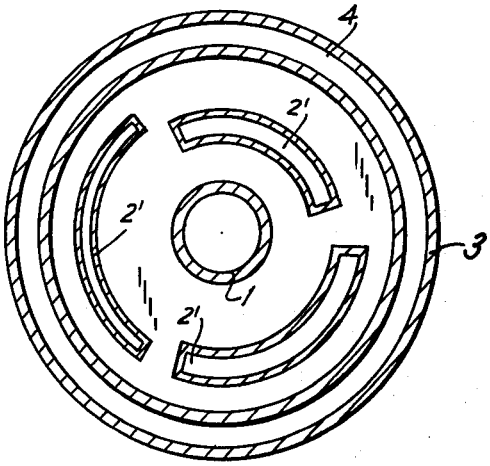
FIG. 4b

FIG.5
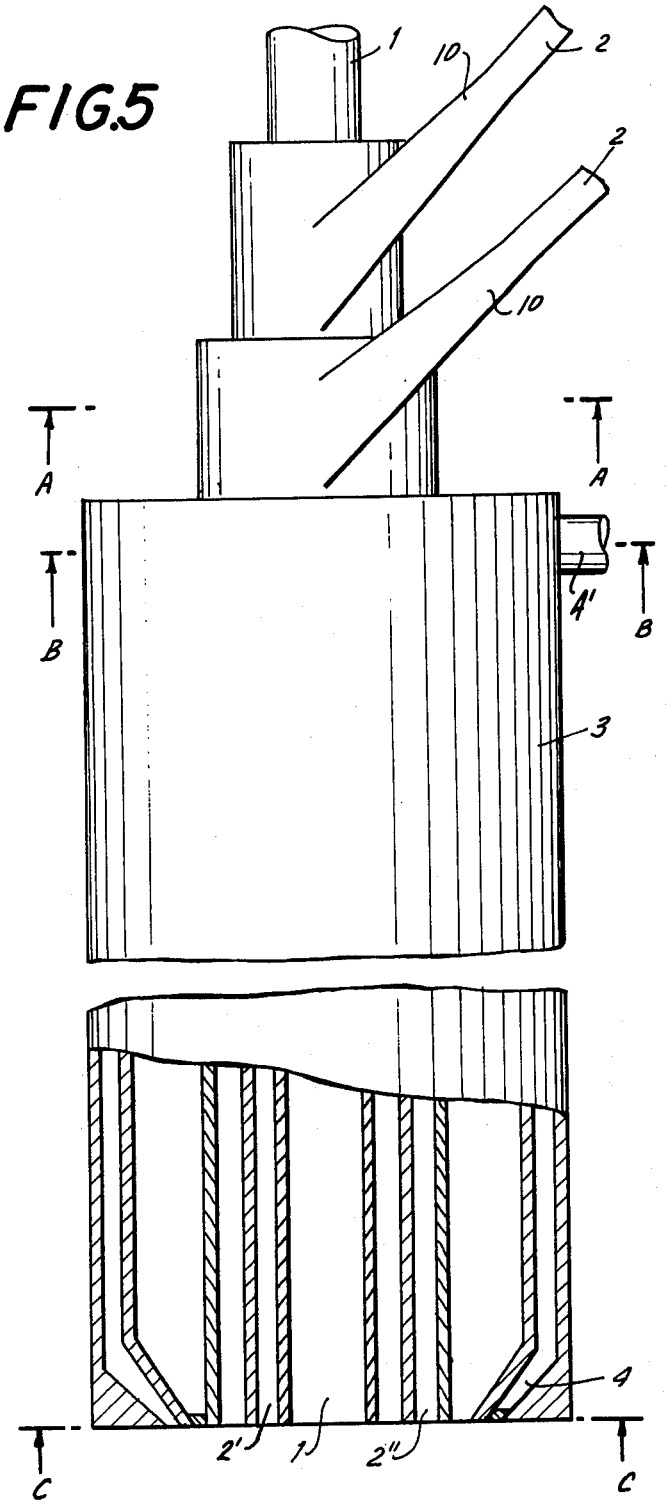
FIG.5a
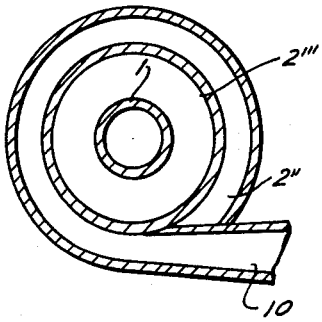
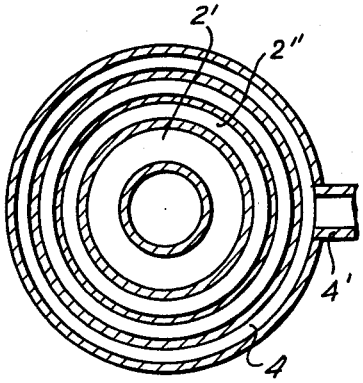
FIG.5b

BURNER FOR GASIFICATION OF POWDERY FUELS

BACKGROUND OF THE INVENTION

This invention relates generally to burners for gasifying powdery fuel materials and, more particularly, it relates to a burner for use in a gasifying reactor operating under a pressure up to 50 bars and combusting brown coal powder and a carburation fluid for producing pressurized coal gas.

Known devices, generally known as burners, for feeding mutually separated streams of powderized fuels and carburation agents into a gasification chamber, have the common feature that the powdery fuel is fed through a center tube axially arranged in the burner. As a rule one or more concentric tubes are so arranged about the central pipe as to form annular channels between each other. These annular channels serve for feeding one or more carburation agents or a mixture of carburation fluids into the reaction chamber. The outlet opening of these channels into the reaction chamber has either an annular cross-section or has the form of a plurality of bores terminating the annular channels and discharging the carburation fluid for reaction with the central jet of powdery fuel.

The feeding of powdery fuels such as brown coal dust into the central burner tube having a circular cross-section is technically simple solution. From the experience the fluidized brown coal dust can be relatively easily fed through smooth and straight tube of uniform cross-sectional area and when considering the specific conditions of the powdery material relatively high density of the dusty jet can be achieved. In known actual experimental plants (for example of U.S. Bureau of Mines Morgentown), as well as from the patent literature (for example German published application No. 2,536,249, U.S. Pat. No. 2,702,744, DDR Pat. No. 127 904) the principle of the central feeding of the fuel to be gasified into the burner is employed. A substantial disadvantage of the central discharge into the reaction chamber of the fuel to be gasified and of concentrically arranged discharge means for the carburation medium such as for example oxygen, is in the fact that due to the recirculation of the generated gas in the reaction chamber the latter is prone to mix up with the carburation medium provided that the latter is not shielded against the recirculating coal gas by means of an additional steam screen. As a consequence of this mixing action, a part of the incoming oxygen is consumed for oxidation of the combustible recirculating coal gas. In the pressurized combustion of the dusty fuel it is of advantage when the entire amount of the carburation oxygen participates in the reaction with the fuel dust and also from the economic point of view it is of advantage when the undesired marginal reactions of the oxygen are eliminated.

Another disadvantage of the feeding of the entire quantity of the coal dust to be gasified in the reaction chamber by means of a single feeding pipe which for technical reasons is symmetrically arranged in the center of the burner occurs in the event of a momentary discontunity of the feeding of the coal dust whereby the operational safety of the plant is lowered. Whereas, in general the feeding of a gaseous carburation medium in the form of a continuous jet can be insured, the supply of a fluidized dusty fluid frequently exhibits irregularities as far as the density of the stream is concerned. As a result, due to considerable variations in the coal dust supply at the exit of the burner there is the danger that the burner and the reaction chamber may become damaged, provided that the corresponding oversupply of oxygen is not immediately reduced in concert with these variations.

SUMMARY OF THE INVENTION

It is, therefore, a general object of the present invention to overcome the aforementioned disadvantages.

More particularly, it is an object of the invention to provide an improved burner of the afore-described type in which the specific consumption of oxygen for combusting brown coal dust is reduced.

Another object of this invention is to provide such an improved burner which has an improved operation and operational safety during the pressure gasification of coal dust.

Still another object of this invention is to provide such an improved burner which requires a reduced installation space in the reactor and which enables a considerably increased output.

An additional object of this invention is to provide a coal gasification reactor which for given output can employ reduced number of burners.

Furthermore, an object of this invention is to provide a burner of the afore-described type in which the reliability of the supply of the dusty fuel material as well as its dissipation and mixing with the carburation agent is substantially increased at any load condition of the reactor.

Still another object of this invention is to provide a burner for gasification of dusty coal material which enables a ready control of the flame and in the event of discontinuity of the jet of dust to insure such symmetrical shape of the flame that the combustion or the reaction chamber cannot break due to the non-uniform temperature distribution and consequently the operation is disturbed only insignificantly.

In keeping with these objects, and other which will become apparent hereinafter, one feature of the invention resides in a burner for use in a reactor for gasification of powderized fuel in the provision of a burner housing, and coaxially arranged within the housing, a central tubular channel and a coaxially arranged peripheral annular channel for feeding respectively a carburation medium into the reactor, at least one intermediate channel in the form of an annular section extending in axial direction for feeding a powdery fuel and a carrier gas mixture into the reactor; an axial intake conduit connected to the central tubular channel; a lateral inlet conduit connected to the peripheral annular channel, and at least one axially directed intermediate inlet conduit connected to the intermediate channel, the inlet conduit having substantially the same cross-sectional area as the effective feeding cross-section of the assigned channels.

In the preferred embodiment of this invention, the ducts for the mixture of the coal dust with the carrier gas stream is formed by two or more annular channels or channels having the form of annular sections extending concentrically with respect to the burner axis and parallel to the central tube for feeding the carburation fluid. Both the central tube and the concentric annular sections extend perpendicularly downwardly into the reactor chamber. The carburation fluid, such as for example, oxygen, or steam or the mixture of oxygen and steam, exits from the central tube into the reaction chamber and in addition it is also supplied from an annular channel arranged at the periphery of the burner housing. The carburation fluid in one of the two feeding channels is diverted to flow at an angle of at least 35° with respect to the direction of flow of the dusty fuel jet. The second of the two carburation streams exits into the reaction chamber in axial direction parallel to the jet of the dusty fuel. This axial stream of carburation fluid streaming parallel to the exit jet of the dusty fuel material emanats preferably from the central tube in connection with an optical or thermo-electric control of the flame performed via the central tube for the carburation fluid.

The burner is designed such that the plurality of inlet conduits for the mixture of the coal dust with a carrier gas has initially a circular cross-section which in the region of its connection to the burner housing continuously change their configuration to adjust their cross-sectional shape to match the annular cross-section of the intermediate channels for the coal dust-carrier gas supply. The cross-section of of these converted inlet openings corresponds to the effective cross-section and as the case may be to the cross-sectional changes of the latter. The individual intermediate channels have such a shape that their outlines form together an approximately closed ring whereby a unification of several streams of dusty fuel is achieved and a symmetrical uniform dust distribution in the reaction chamber is insured.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is an elevational view of one embodiment of the burner of this invention;

FIG. 2A is a sectional view of the burner of FIG. 2 taken along the line A—A;

FIG. 2B is a sectional view of the burner of FIG. 2 taken along the line B—B;

FIG. 2C is a bottom view of the burner of FIG. 2;

FIG. 3 is an elevational view, partly in section, of another embodiment of the burner of this invention;

FIG. 3A is a sectional view of the burner of FIG. 3 taken along the line A—A;

FIG. 3B is a sectional view of the burner of FIG. 3 taken along the line B—B;

FIG. 4 is an elevational view, partly in section of a modification of the burner of FIG. 3;

FIG. 4A is a sectional view of the burner of FIG. 4 taken along the line A—A;

FIG. 4B is a sectionakl view of the burner of FIG. 4 taken along the line B—B;

FIG. 5 is an elevational view, partly in section, of still another embodiment of the burner of this invention;

FIG. 5A is a sectional view of the burner of FIG. 5 taken along the line A—A;

FIG. 5B is a sectional view of the burner of FIG. 5 taken along the line B—B.

DESCRIPTION OF THE PREFERRED EMBODIMENTS

Figure 1:
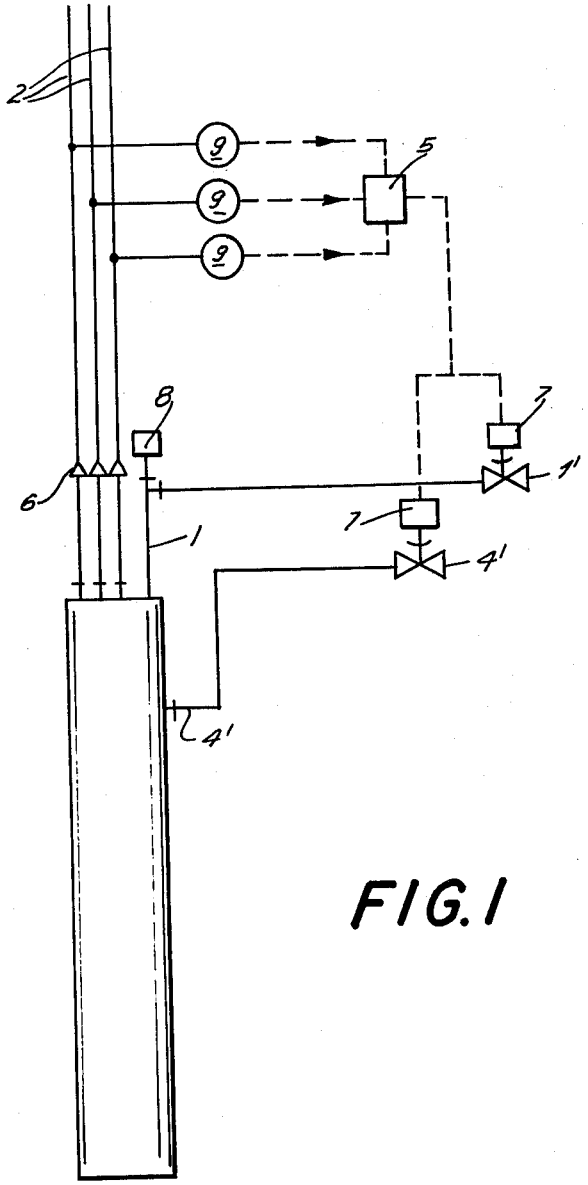
FIG. 1 is a schematic view of the burner of this invention together with control units for regulating the combustion process.

Referring firstly to FIGS. 1 and 2, there is illustrated a burner having a tubular housing 3 insertable in an upright position from above into a non-illustrated reaction chamber for gasification of powderized fuel such as finely distributed brown coal. The mixture of coal dust with a carrier gas is supplied at a velocity of 2 to 10 meters per second through inlet conduits 2 of equal cross-section which at point 6 are slightly increased. In the burner housing 3, the inlet conduits 2 change their shape into annular sections 2' (FIG. 2C) each having the same cross-sectional area throughout the range of the change-over as that of the tubular conduits 2 below the points 6. In this embodiment respective channels 2' are symmetrically arranged between the peripheral annular channel 4 and the central tube 1 for supplying the carburation fluid such as oxygen for example. Each annular section 2' forms with the central axis of the burner an angle of approximately 120° and consequently the coal dust when discharged at the bottom of the burner forms a closed ring which insures a symmetrical shape of the flame.

As seen from FIG. 1, each fuel supply conduit 2 is connected to a device 9 for measuring the density of the supplied powdery fuel and the output signal from the devices 9 is fed through a regulator 5 which in turn activates control units 7 for regulating the supply of carburation fluid in conduits 1' and 4' connected to the central tubular channel 1 and peripheral annular channel 4. In this manner the control circuit 9, 5, and 7 insures that the supply of carburation fluid is proportional to the variations in the supply of powdery fuel.

This invention is based on the recognition that the supply of a fluidized mixture of a coal dust with a carrier gas can be achieved without hindrance even at a changing outline of the cross-section of the feeding conduit and at heavy loads of the dust (up to 900 kilograms of dust per cubic meter of carrier gas) provided that the flowing conditions are met.

In each vertical portion $\Delta L$ of the fuel supply channels 2 in the region L of the burner where the cross-section of the supply channels undergoes transition from a circular cross-section to the shape of an annular section 2' the corresponding cross-sections have the same area;

The deviation from the direction of the fuel stream in respective inlet conduits 2, resulting from the change of the cross-sectional outline should not exceed 8°.

It has been also found by experience that due to the enlargement by about 20% of the cross-section of the perpendicular fuel supply conduits 2 at point 6, the density of the supplied stream of the coal dust is equalized especially at high loads of the coal powder. The length of the increased cross-section of the tubular inlet conduits as well as the actual magnitude of the cross-sectional enlargements depends on overall feeding conditions of the entire feeding circuit.

As it has been described above, the carburation fluid such as oxygen, steam or the mixture of oxygen and steam is supplied through the central pipe 1 and simultaneously through the peripheral annular channel 4. One of the two channels 1 and 4 diverts the fed carburation fluid at an angle of at least 45° toward the discharged annular jet of the powdery fuel whereas the second stream of the carburation fluid is discharged axially parallel through the stream of fluid.

A carburation fluid which reaches the velocity of approximately to 15 to 150 meters per second dissipates the annular jet of the powdery fuel and due to the oblique angle of attack of the carburation fluid against the jet of the powdery fuel an intensive mixing action is insured.

The flame can be monitored and controlled through the central channel 1 for the carburation fluid by means of a flame control device 8.

Figure 3C:
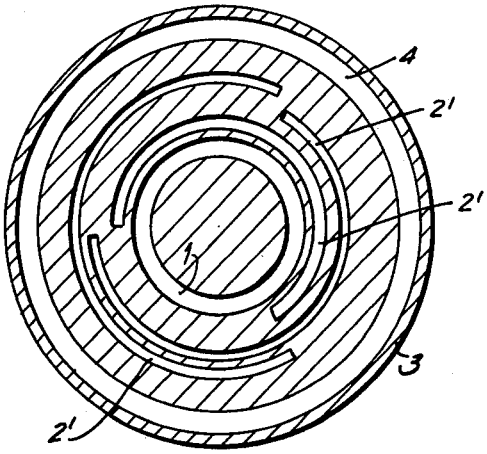
FIG. 3C is a bottom view of the burner of FIG. 3.
Figure 4C:
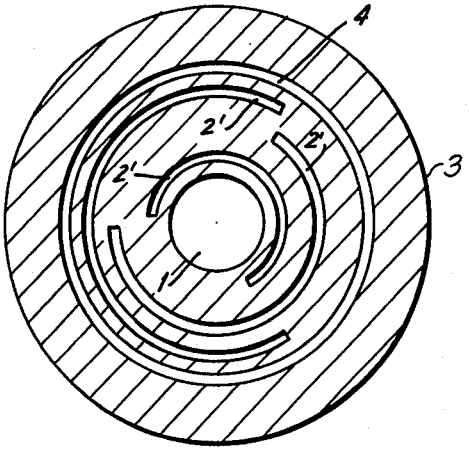
FIG. 4C is a bottom view of the burner of FIG. 4.

As illustrated in FIGS. 2 through 4C the supply of the powdery fuel into the burner 3 is effected by means of perpendicular fuel feeding conduits 2 which at the lower part of the burner 3 transit into the exit channels in the form of annular sections 2' having the same cross-sectional area. In the embodiment of FIG 3, the powdery fuel feeding conduits transit into annular sections of different radii and each covering a central angle of 240° so that the emanating jet of powdery fuel is composed of at least two concentric jets. In this example the central tubular channel 1 is at its lower range flared and a conical buffer diverts resulting annular jets of carburation fluids approximately at an angle of 45° towards the coaxially directed annular jet of the powdery fuel. The outer channel 4 for the carburation fluid is directed parallel to the jet of the powdery fuel.

In the modification of the burner as illustrated in FIG. 4, it is the peripheral annular channel 4 which diverts the carburation fluid at an angle of approximately 45° towards the coaxial jet of powdery fuel while the central tubular channel 1 for the carburation fluid is directed in axial direction.

The overlapping annular sections 2' in the embodiments of FIGS. 3 and 4 insure the symmetry of the flame even in the case when the supply of the fuel in one of the conduits 2 is interrupted.

Figure 5C:
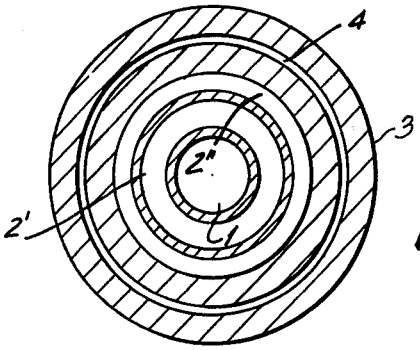
FIG. 5C is a bottom view of the burner of FIG. 5.

In the embodiment as illustrated in FIG. 5, the burner housing 3 includes two concentrically arranged annular channels 2''' and $2^{IV}$ surrounding the central tubular channel 1 for the carburation fluid. Each annular channel 2''' and $2^{IV}$ opens into an assigned annular space 2' and 2'' of the same cross-sectional area as that of the channel at the top of the burner housing 3. Each channel 2''' and $2^{iv}$ communicates via a rectangular slot and a tangentially directed inclined connecting piece 10 with the tubular supply conduit 2 for the powdery fuel. Similarly, as in the preceding example, the variable cross-sectional outline of the tangential connecting piece encloses the same cross-sectional area as the inlet conduit 2 and the outlet annular channels 2' and 2''. The connecting piece 10 is inclined relative to the axis of the burner of about 25°.

The annular jet of the powdery fuel emanating from the exit opening at the bottom of the burner housing 3 is dissipated by the impact of the carburation fluid emanating at an angle of at least 45° from the peripheral channel 4 at a high speed between 15 and 150 meters per second thus mixing intensively the coal dust with the carburation fluid. The annular discharge opening for the coal dust insures a fully symmetrical combustion. The symmetry is maintained even in the event when the feeding stream in one of the inlet conduits 2 is interrupted and facilitates the starting of the burner operation with different number of fuel feeding streams. The control of the carburation fluid is effected in the same manner as illustrated in FIG. 1.

Due to the employment of a plurality of separate streams of the powdery fuel which are symmetrically arranged at the exit plane of the burner the danger of the undesired penetration of oxygen into the processing units downstream of the reaction chamber is eliminated or at least essentially reduced even when disturbances in the supply of the powdery fuel take place.

The burner of this invention enables an alternating mode of the combusting operation by varying the number of the fed streams of the powdery fuel and thus increases the range of the control of the gas producing operation.

It will be understood that each of the elements described above, or two or more together, may also find a useful application in other types of constructions differing from the type described above.

While the invention has been illustrated and described as embodied in specific examples of the burner for gasification of a coal dust, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic aspects of this invention.

What is claimed as new and desired to be protected by Letters Patent is set forth in the appended claims:

1. A burner for use in a reactor for gasification of powderized fuel, comprising: a burner housing enclosing a central tubular channel; a coaxially arranged boundary annular channel; at least one intermediate channel in the form of at least annular section arranged concentrically between said tubular channel and said boundary annular channel; first conduit means communicating with said central tubular channel and said boundary annular channel for introducing streams of carburation fluid therein; second conduit means including at least one tubular conduit communicating with said one intermediate annular section and having a transition portion of a successively different outline of its cross-section enclosing at any successive point the same area as that of said tubular conduit; said first inlet conduit means including an axial inlet conduit connected to said central tubular channel and a lateral inlet conduit connected to said boundary annular channel; and further including at least three intermediate channels in the form of annular sections of the same radii and being uniformly distributed on a circle and each communicating with a vertical inlet conduit having a circular cross-section enclosing the same area as the assigned annular section channel.

2. A burner for use in a reactor for gasification of powderized fuel, comprising: a burner housing enclosing a central tubular channel; a coaxially arranged boundary annular channel; at least one intermediate channel in the form of at least annular section arranged concentrically between said tubular channel and said boundary annular channel; first conduit means communicating with said central tubular channel and said boundary annular channel for introducing streams of carburation fluid therein; second conduit means including at least one tubular conduit communicating with said one intermediate annular section and having a transition portion of a successively different outline of its cross-section enclosing at any successive point the same area as that of said tubular conduit; said first inlet conduit means including an axial inlet conduit connected to said central tubular channel and a lateral inlet conduit connected to said boundary annular channel; and further including a plurality of intermediate channels in the form of annular sections having at least two different radii and being uniformly distributed around said central tubular channel to form at their exit openings at least two coaxial tubular jets of said mixture of powdery fuel and carrier gas.

* * * * *